US008146839B2

(12) United States Patent
Braun et al.

(10) Patent No.: US 8,146,839 B2
(45) Date of Patent: Apr. 3, 2012

(54) FUEL INJECTION DEVICE FOR AN INTERNAL COMBUSTION ENGINE

(75) Inventors: Wolfgang Braun, Ditzingen (DE); Dirk Vahle, Vaihingen Enz (DE); Martin Katz, Stuttgart (DE); Alexander Wernau, Blaufelden (DE)

(73) Assignee: Robert Bosch GmbH, Stuttgart (DE)

( * ) Notice: Subject to any disclaimer, the term of this patent is extended or adjusted under 35 U.S.C. 154(b) by 537 days.

(21) Appl. No.: 12/096,082

(22) PCT Filed: Jan. 12, 2007

(86) PCT No.: PCT/EP2007/050300

§ 371 (c)(1),
(2), (4) Date: Jun. 4, 2008

(87) PCT Pub. No.: WO2007/098975

PCT Pub. Date: Sep. 7, 2007

(65) Prior Publication Data

US 2009/0020632 A1 Jan. 22, 2009

(30) Foreign Application Priority Data

Feb. 24, 2006 (DE) ..... 10 2006 008 648

(51) Int. Cl.

| | |
|---|---|
| ***B05B 1/30*** | (2006.01) |
| ***B05B 1/14*** | (2006.01) |
| ***F02M 61/20*** | (2006.01) |
| ***F02M 61/00*** | (2006.01) |
| ***F23D 14/68*** | (2006.01) |

(52) U.S. Cl. ..... 239/533.9; 239/533.1; 239/533.2; 239/533.11; 239/583; 239/584; 239/590

(58) Field of Classification Search ..... 239/533.1, 239/533.2, 533.3, 533.4, 533.9, 533.11, 570, 239/571, 583, 584, 585.1, 585.2, 585.4, 585.5, 239/590

See application file for complete search history.

(56) References Cited

U.S. PATENT DOCUMENTS

| | | | | |
|---|---|---|---|---|
| 3,610,529 | A * | 10/1971 | Huber | 239/96 |
| 5,577,667 | A * | 11/1996 | Ganser | 239/533.8 |
| 5,697,554 | A * | 12/1997 | Auwaerter et al. | 239/88 |
| 6,598,811 | B2 * | 7/2003 | Boecking | 239/533.8 |
| 6,971,592 | B2 * | 12/2005 | Boecking | 239/533.2 |
| 2006/0169802 | A1 * | 8/2006 | Pauer | 239/533.2 |
| 2006/0208107 | A1 * | 9/2006 | Heinz | 239/533.2 |

FOREIGN PATENT DOCUMENTS

| | | | |
|---|---|---|---|
| DE | 10 2004 024 282 | A1 | 12/2005 |
| EP | 1 559 908 | A1 | 8/2005 |
| EP | 1 624 181 | A1 | 2/2006 |
| WO | WO 2006/008201 | A1 | 1/2006 |

* cited by examiner

*Primary Examiner* — Len Tran
*Assistant Examiner* — Ryan Reis
(74) *Attorney, Agent, or Firm* — Ronald E. Greigg

(57) ABSTRACT

A fuel injection device for an internal combustion engine includes a housing and a valve element which is arranged in the housing. The valve element interacts, in the region of a fuel outlet opening, with a valve seat. The valve element is embodied by at least one first part and at least one second part which are coupled to one another by means of a hydraulic coupler. The hydraulic coupler has a coupling chamber which is delimited at least partially by a sleeve which is guided on the first part of the valve element. Additionally a guide element guides an end region of the first part of the valve element, which end region being oriented toward the second part of the valve element.

14 Claims, 8 Drawing Sheets

FUEL INJECTION DEVICE FOR AN INTERNAL COMBUSTION ENGINE

CROSS-REFERENCE TO RELATED APPLICATION

This application is a 35 USC 371 application of PCT/EP 2007/050300 filed on 12 Jan. 2007.

BACKGROUND OF THE INVENTION

1. Field of the Invention

The invention relates to a fuel injection device for an internal combustion engine.

2. Description of the Prior Art

A fuel injection device is known from the market, which can be used to inject fuel directly into a combustion chamber of an internal combustion engine with which it is associated. To this end, a valve element is situated in a housing, which in the region of a fuel outlet opening, has a pressure surface that on the whole, acts in the opening direction of the valve element. At the opposite end of the valve element, there is a control surface that acts in the closing direction and delimits a control chamber. The control surface acting in the closing direction is on the whole larger than the pressure surface acting in the opening direction when the valve element is open.

When the fuel injection device is closed, a higher fuel pressure such as the pressure supplied by a fuel accumulator line (rail) acts on a region of the pressure surface acting in the opening direction and on the control surface acting in the closing direction. To open the valve element, the pressure acting on the control surface is reduced until the hydraulic force resultant acting on the pressure surface in the opening direction exceeds the force acting in the closing direction. This achieves an opening of the valve element.

A requirement for the function of this fuel injection device is a seal between the region in which the comparatively small pressure surface acting in the opening direction is situated and the region of the valve element in which the comparatively large control surface acting in the closing direction is situated. In the known fuel injection device, leakage fluid is conveyed out of the region of the seal via a leakage line.

The object of the present invention is to modify a fuel injection device of the type mentioned at the beginning so that it is as simple and inexpensive as possible and can be used at a very high operating pressure. In addition, the fuel injection device should function reliably, even when there are production tolerances.

SUMMARY AND ADVANTAGES OF THE INVENTION

In the fuel injection device according to the present invention, the hydraulic coupling of two separate parts of the valve element significantly increases the design freedom of the fuel injection device because the respective parts of the valve element can be optimally adapted to the location inside the fuel injection device. For example, the elastic properties of the valve element can, through an appropriate selection of the material used and the dimensions, be optimally adapted to the given area of use. Furthermore, the manufacture of the valve element as a whole is significantly simplified since in addition, parts with a constant diameter are used. This makes it possible for the fuel injection device to be constructed of simple parts, which on the one hand, facilitates production and on the other hand, permits a compact design. Furthermore, it is possible to continue to use numerous components of previous devices for implementation of the present invention.

Another advantage of the hydraulic coupler is the compensation of tolerances, which simplifies the production and assembly. The coupling of two parts of the valve element by means of a hydraulic coupler also permits the implementation of a certain movement damping.

The sleeve provided according to the present invention facilitates implementation of the hydraulic coupler and simplifies the housing work required. The guide element, which according to the present invention is provided separately from the housing, additionally minimizes an alignment error of the sleeve in relation to a sealing surface that cooperates with it on the housing. This can turn out to be particularly useful if the first part of the valve element is particularly long and if the sleeve is guided on the first part of the valve element in a particularly snug fashion. This minimizes or entirely eliminates leaks in the coupling chamber. It is therefore possible to dispense with a complex and cost-intensive calibration process. A wear-induced change in the functional properties of the fuel injection device according to the present invention is reduced. The guidance by means of the guide element compensates for production tolerances, thus assuring a reliable injector function.

The fuel injection device according to the present invention is particularly simple in terms of its construction if the sleeve rests against the guide element. In this case, a sealing surface can be embodied on the guide element against which the sleeve rests, exactly at right angles to the guide axis of the guide element thus minimizing to a particularly significant degree any misalignment of the sleeve guided on the first part in relation to the sealing surface on the guide element.

In a modification of this, the present invention proposes providing a fluid passage leading from one side of the guide element to the other in at least part of a guide region of the guide element or a complementary region of the first part of the valve element. This achieves a clear functional separation such that the guide region of the guide element has a pure guiding function and the sleeve has a purely sealing function. Such a separation of the functions permits an optimal layout. In a concrete modification of this, the fluid passage can be constituted by a guidance play between the guide element and the first part of the valve element. This is particularly easy to implement from a production engineering standpoint.

In another advantageous modification of the fuel injection device according to the present invention, the guide element includes a stroke stop for the second part of the valve element. This is advantageous primarily in those fuel injection devices with which comparatively large fuel quantities are to be injected, for example in commercial vehicles. In a fuel injection device of this kind, because of its multipart design, production tolerances in the longitudinal dimensions can lead to significant stroke tolerances. Prior to now, these were reduced through calibration of an adjusting element. To that end, before assembly of the individual parts of the fuel injection device, each relevant assembly dimension had to be measured in terms of its influence on the stroke tolerance. Based on these measurement values, it was possible to set the correct stroke value by selecting from a group of adjusting elements.

With the stroke stop for the second part of the valve element now being integrated into the guide element, it is possible to dispense with such a procedure, thus simplifying the assembly. If, however, other requirements make it necessary for the stroke of the second part of the valve element to be adjustable, then this can occur by placing a stroke adjusting element between the second part of the valve element and the stroke stop in or on the guide element.

The manufacture of the fuel injection device is further simplified if the guide element includes a through opening, preferably with a flow throttle, which connects a pressure chamber in the region of the valve seat to a high-pressure chamber.

In order to assure an optimum seal of the coupling chamber and of the high-pressure chamber or a fluid conduit, the guide element can be clamped between two housing bodies of the fuel injection device; its contact surfaces with the housing bodies are embodied so that the centers of their surface areas are situated at least approximately on a center axis of a guide region of the guide element.

According to another proposal of the present invention, the sleeve is acted on by a spring that rests against a shoulder embodied on the first part of the valve element. This permits the implementation of a unit that can be preassembled and includes at least the first part of the valve element, the sleeve, the spring, and possibly the guide element. In addition to saving time in the final assembly of the fuel injection device, this also prevents damages to the high-precision guidance between the sleeve and the first part of the valve element during the final assembly. In addition, this eliminates the otherwise necessary captive interim storage of the sleeve during the installation and calibration process of the spring. An interim storage of this kind eliminates the danger of the sleeve becoming contaminated, damaged, or even lost. Furthermore, this simplifies the housing and consequently its manufacture since now, a smooth through bore without a step can be provided to accommodate the valve element in the housing. This also improves the high-pressure strength of the fuel injection device and its greater reservoir volume (chamber between the valve element and through bore in the housing) leads to a reduction in pressure oscillations.

An alternative to this lies in the fact that the sleeve is acted on by a first spring that rests against a shoulder embodied on the one side of an annular element, whose other side is acted on by a second spring that rests at least indirectly against the housing and is coupled by means of a coupling element to the valve element in its closing direction.

The guide element can have a centering section, preferably a centering collar, which centers the guide element in relation to a housing body. This also at least indirectly centers the valve element and other regions of the housing that are spaced apart from the coupler.

BRIEF DESCRIPTION OF THE DRAWINGS

Particularly preferred exemplary embodiments of the present invention will be explained in greater detail below in conjunction with the accompanying drawings.

DESCRIPTION OF THE PREFERRED EMBODIMENTS

Figure 1:
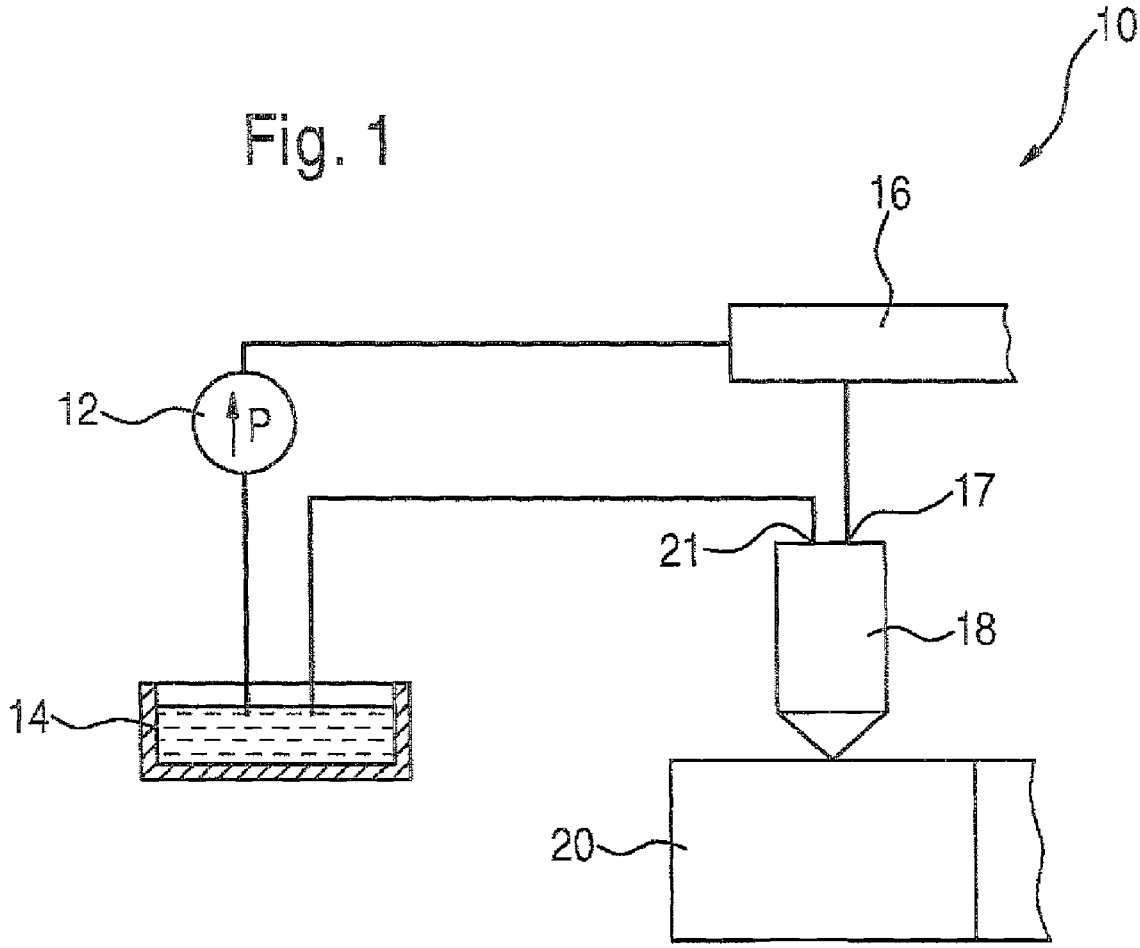
FIG. 1 is a schematic depiction of an internal combustion engine equipped with a fuel injection device.

In FIG. 1, an internal combustion engine is labeled as a whole with the reference numeral 10. Its primary function is to drive a motor vehicle that is not shown. A high-pressure delivery device 12 feeds fuel from a fuel tank 14 to a fuel pressure accumulator 16 ("rail"). In this rail, the fuel—for example diesel or gasoline—is stored at a very high pressure. A plurality of fuel injection devices 18 that inject the fuel directly into combustion chambers 20 associated with them are each connected to the rail 16 by means of a respective high-pressure connection 17. Each of the fuel injection devices 18 has a respective low-pressure connection 21 via which they are connected to a low-pressure region, in this case the fuel tank 14.

Figure 2:
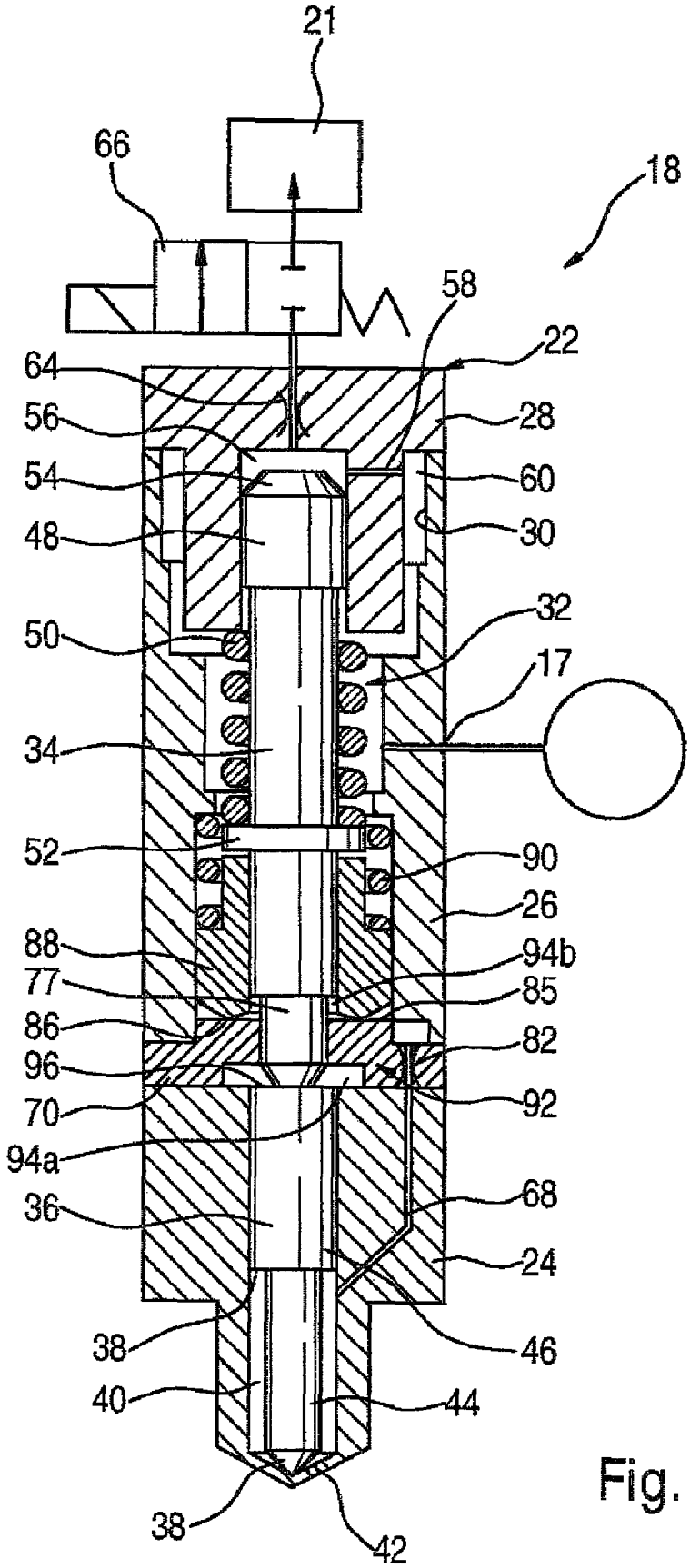
FIG. 2 is a schematic, partially sectional depiction of a first embodiment of the fuel injection device from FIG. 1.
Figure 3:
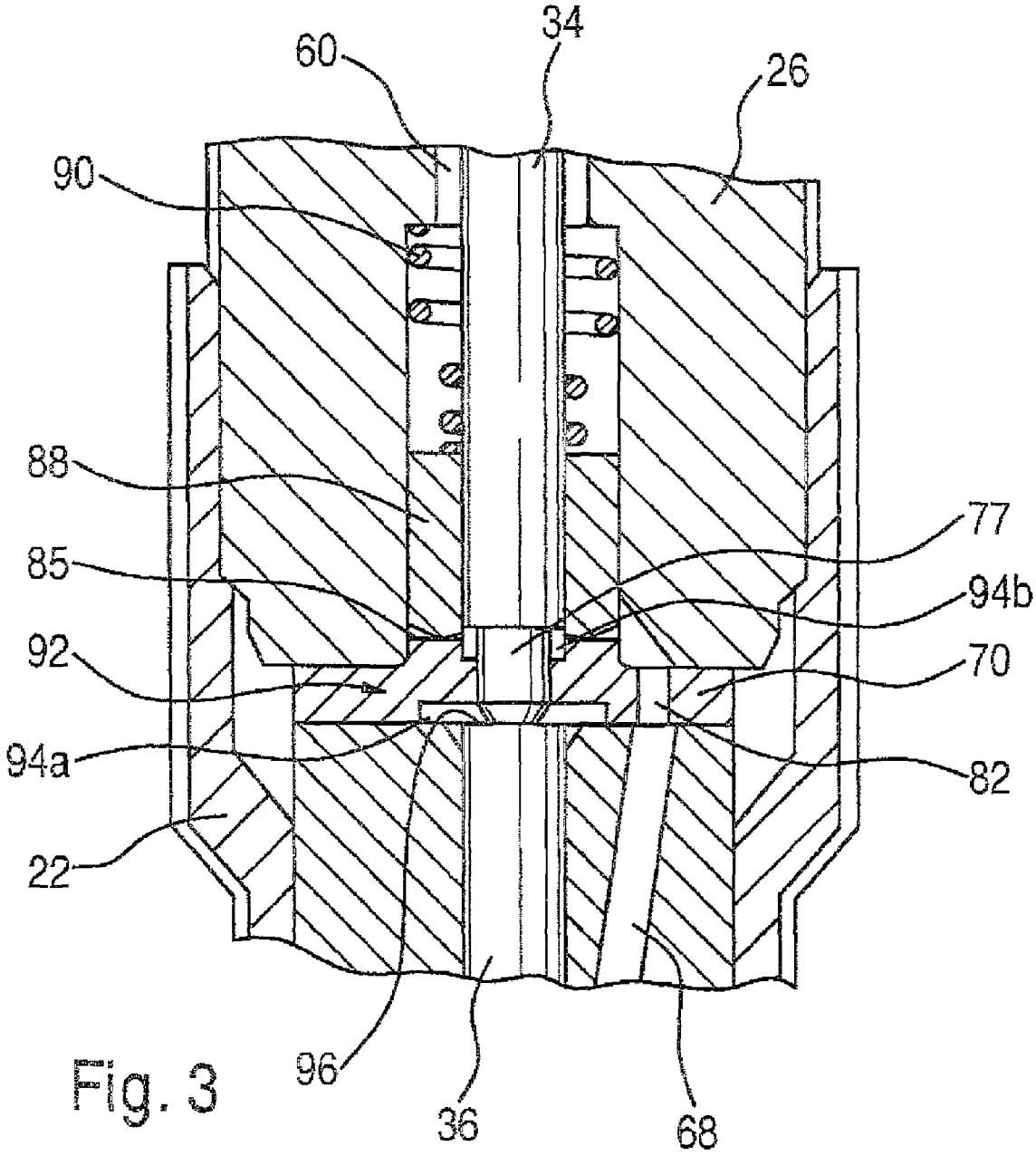
FIG. 3 is a detailed depiction of a region of the fuel injection device from FIG. 2.

The fuel injection devices 18 can be embodied in a first embodiment corresponding to FIGS. 2 and 3: the fuel injection device 18 in the present exemplary embodiment depicted therein has a housing 22 with a nozzle body 24, a main body 26, and an end body 28. It is also possible for the main body 26 and end body 28 to be of one piece with each other. In the longitudinal direction of the housing 22, there is a step-shaped recess 30 in which a needle-like valve element 32 is contained. This needle-like valve element 32 is composed of two parts, namely a control piston 34 and a nozzle needle 36.

The nozzle needle 36 has pressure surfaces 38 that delimit a pressure chamber 40 and whose hydraulic resultant force is oriented in the opening direction of the nozzle needle 36. At its lower end in FIG. 2, the nozzle needle 36 cooperates with a valve seat (unnumbered) on the housing in a manner that is not shown in detail in FIG. 2. It is thus possible to disconnect fuel outlet openings 42 from the pressure chamber 40 or to connect them to it. The nozzle needle 36 has a section 44 with a smaller diameter and a section 46 with a larger diameter. The nozzle needle 36 is guided in a longitudinally movable fashion in the nozzle body 24 by means of the section 46.

The control piston 34 is accommodated in the main body 26. An end region 48 at the top of the control piston 34 in FIG. 2 is embodied as a guide, which is accommodated and guided in a sleeve-like extension of the end body 28. A spring 50 rests against a shoulder formed on the control piston 34 by means of an annular collar 52 and acts on the control piston 34 in the closing direction. The axial end surface at the top of the control piston 34 in FIG. 2 constitutes a hydraulic control surface 54 acting in the closing direction of the valve element 32. Together with the end body 28, it delimits a control chamber 56.

An inlet throttle 58, which is provided in the sleeve-like extension of the end body 28, connects the control chamber 56 to an annular chamber 60, which, in the present case, is situated between the sleeve-like extension of the end body 28 and the main body 26 and is in turn connected to the high-pressure connection 17. The annular chamber 60 is formed by means of the stepped recess 30 that are let into the main body 26. The control chamber 56 is also connected to a 2/2-way switching valve 66 by means of an outlet throttle 64, which is provided in the end body 28. Depending on its switching position, this valve either connects the outlet throttle 64 to the low-pressure connection 21 or disconnects the two. The annular chamber 60 is also connected to the pressure chamber 40 via at least one conduit 68.

Figure 4:
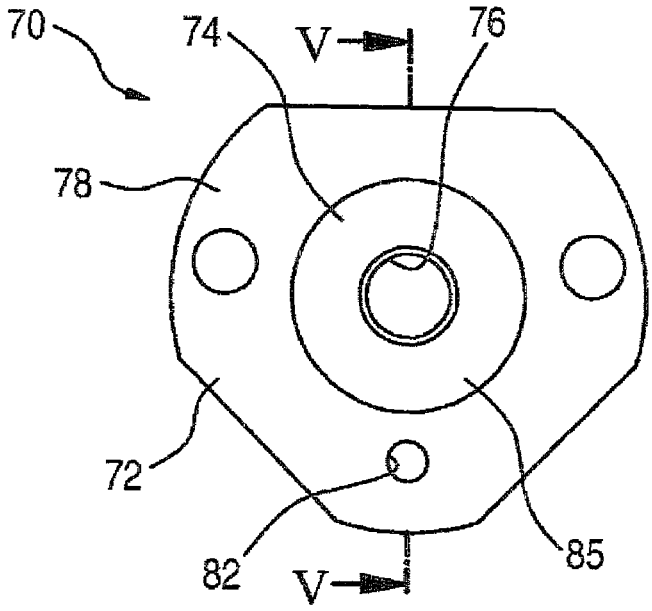
FIG. 4 is a top view of a guide element of the fuel injection device from FIG. 3.
Figure 5:
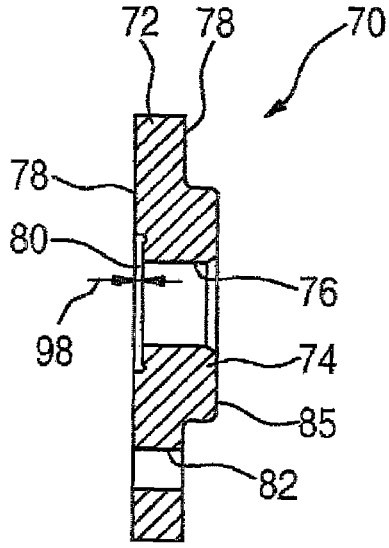
FIG. 5 is a section along the line V-V from FIG. 4.

A guide element 70 is clamped between the nozzle body 24 and the main body 26. Its precise design is shown in FIGS. 4 and 5: according to these figures, the guide element 70 includes a base plate 72 and a cylindrical projection 74 that is formed onto the plate and constitutes a guide collar that has a centering function. Concentric to the projection 74, the guide element 70 is provided with a guide bore 76 that constitutes a guide region and, in the installed positioned depicted in FIGS. 2 and 3, cooperates with a guide in the end region 77 at the bottom of the control piston 34 in FIGS. 2 and 3. The top and bottom surfaces of the base plate 72 are embodied as high-pressure sealing surfaces 78, which, in the installed position, provide a reliable seal of the housing 22, in particular of the annular chamber 60 and the chambers situated inside the guide element 70, in relation to the surroundings of the fuel injection device 18. The achievement of a good sealing action also depends on the position of the center point of the surface area in relation to the center axis. This is achieved through a corresponding embodiment of the outer contour of the base plate 72 so that the center point of the surface area is situated at least approximately on a center axis (not shown) of the guide bore 76.

The underside of the base plate 72 has a bore shoulder 80 let into it, which is concentric to the guide bore 76 and has a greater diameter than it. The diameter of the bore shoulder 80 is also greater than the diameter of the section 46 of the nozzle needle 36. In this way, the bore shoulder 80 constitutes a stroke stop for the nozzle needle 36 in a manner that will be explained in greater detail below. The base plate 72 of the guide element 70 also has an eccentric through opening or through bore 82 let into it, which is part of the conduit 68 in the installed position. In some instances in which the fuel injection device 18 is used in the internal combustion engine 10, it is necessary for the through opening 82 to include a flow throttle of the kind depicted in FIG. 2.

An end surface 85, which is embodied on the projection 74 and constitutes a sealing surface, is machined very precisely at right angles to the axis of the guide bore 76. In the installed position shown in FIGS. 2 and 3, a sleeve 88 rests with a sealing edge 86 against the sealing surface and is guided with a small amount of play on the control piston 34. The sleeve is pushed against the guide element 70 by a spring 90, which in turn rests against the main body 26. The sleeve 88 constitutes part of a hydraulic coupler 92 that couples the first part of the valve element 32, namely the control piston 34, to the second part of the valve element 32, namely the nozzle needle 36. To this end, the hydraulic coupler 92 includes a hydraulic coupling chamber that has subchambers 94*a* and 94*b* and is situated between the sleeve 88, the guide element 70, the end region at the bottom of the control piston 34 in FIGS. 2 and 3, and the end region at the top of the nozzle needle 36 in FIGS. 2 and 3. The volume constituted by the guidance play between the guide bore 76 and the guide 77 on the control piston 34 is dimensioned so that the subchambers 94a and 94b of the coupling chamber 94 constitute a coherent control volume without any hydraulic influence. This volume thus constitutes a fluid passage from one side to the other of the guide element 70. Alternatively or in addition, the fluid passage can also include at least one groove in the guide bore 76 and/or at least one flattened region on the guide piston 34.

The fuel injection device 18 shown in FIGS. 2 and 3 functions as follows: in the initial state when the switching valve 66 is without current, the control chamber 56 is disconnected from the low-pressure connection 21 and is connected via the inlet throttle 58 to the high-pressure connection 17 and therefore to the rail 16. Consequently, the same pressure prevails in the control chamber 56 as in the annular chamber 60. It also prevails in the pressure chamber 40 via the conduit 68. Due to certain inevitable leakages through the guidance of the nozzle needle 36 in the nozzle body 24 and the guidance of the sleeve 88 on the control piston 34, this pressure also prevails in the coupling chamber 94*a*, 94*b*. On the whole, this configuration yields a force acting in the closing direction of the valve element 32, which presses the valve element 32 against the valve seat in the region of the fuel outlet openings 42 and which is exerted on the control piston 34 by the compression spring 50. Consequently, fuel cannot emerge from the fuel outlet openings 42.

If electrical current is then supplied to the switching valve 66, then the outlet throttle 64 is connected to the low-pressure connection 21. As a result, the pressure in the control chamber 56 decreases. On the whole, this yields a force acting in the opening direction of the control piston 34, which begins to move upward in FIGS. 2 and 3 in opposition to the force of the spring 50. As a result, the pressure in the coupling subchamber 94*a* is reduced by the volume increase. The resulting pressure and force difference between the pressure surfaces 38 and an end surface 96 of the nozzle needle 36 that delimits the coupling subchamber 94*a* causes the nozzle needle 36 to also move upward in FIGS. 2 and 3, i.e. it lifts away from its valve seat in the region of the fuel outlet openings 42. Consequently, fuel can flow from the rail 16 through the high-pressure connection 17, the annular chamber 60, the conduit 68, and the pressure chamber 40 and can be injected via the fuel outlet openings 42 into the combustion chamber 20.

Figure 6:
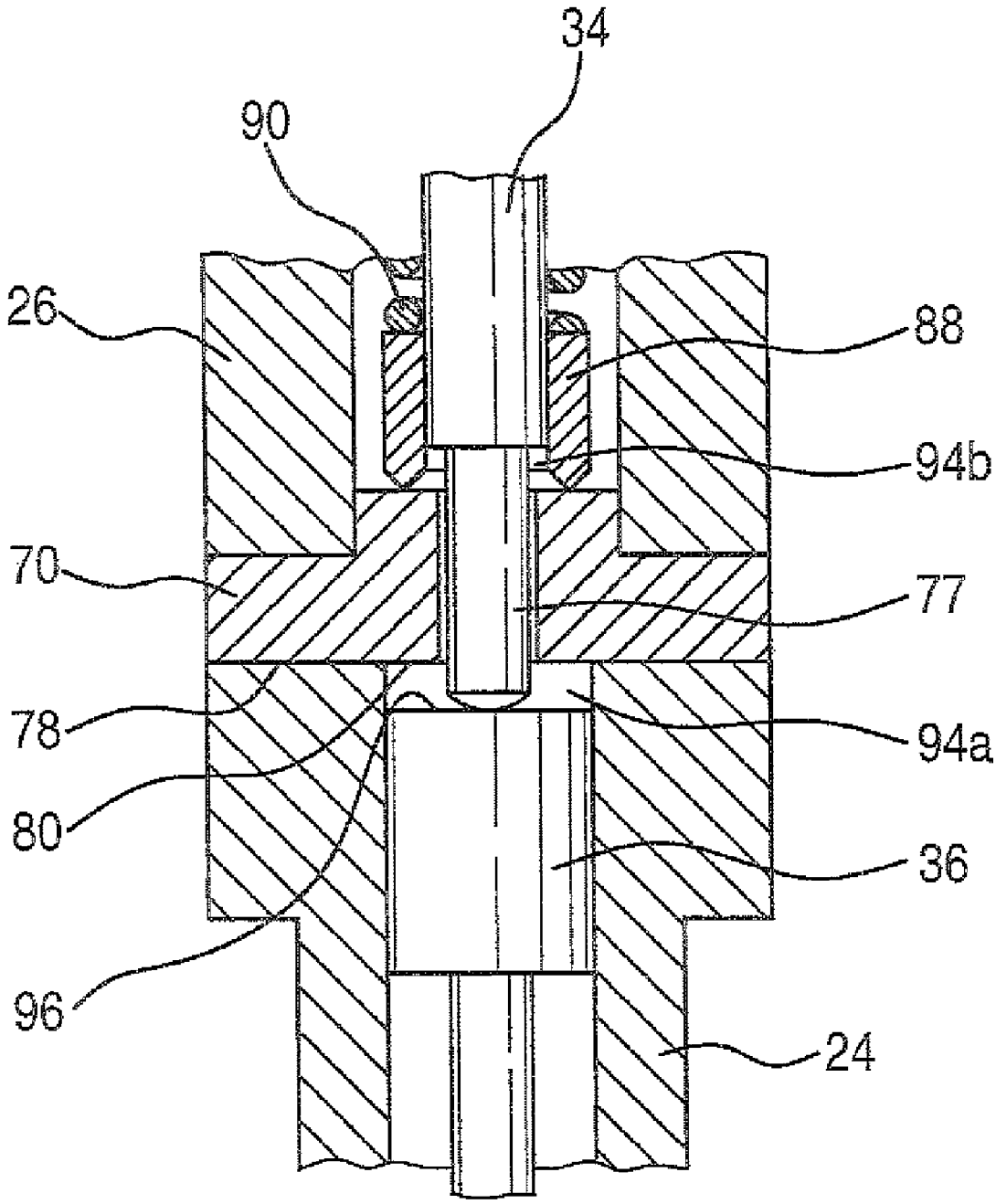
FIG. 6 is a depiction similar to FIG. 2 of a region of a second embodiment of a fuel injection device.

The guide element 70 holds the valve element 32 and the control piston 34 in position in relation to the sealing edge 86. This prevents a misalignment of the sleeve 88 in relation to the sealing surface 85. Such a misalignment would lead to leakage between the annular chamber 60 and the coupling chamber 94*a*, 94*b* and therefore to a malfunction of the fuel injection device 18. The stroke of the nozzle needle 36 is limited by the stroke stop 80. As shown in FIGS. 2 through 5, stroke of the nozzle needle 36 can be implemented by machining the bore shoulder 80 or by machining a shoulder on the end surface 96 of the nozzle needle 36. In this case, the sealing surface 78 simultaneously constitutes the stroke stop for the end surface 96 of the nozzle needle 36 (see FIG. 6).

The control piston 34 is conveyed farther in its stroke motion. For this reason, the free stroke of the control piston 34 must always be greater than the maximum stroke of the nozzle needle 36. Because of the narrow guidance play between the sleeve 88 and the control piston 34 and because of the resulting slight leakage into the coupling chamber 94*a*, 94*b*, however, the control piston 34 is sharply braked in its stroke motion so that it can execute only a slight additional movement.

Figure 7:
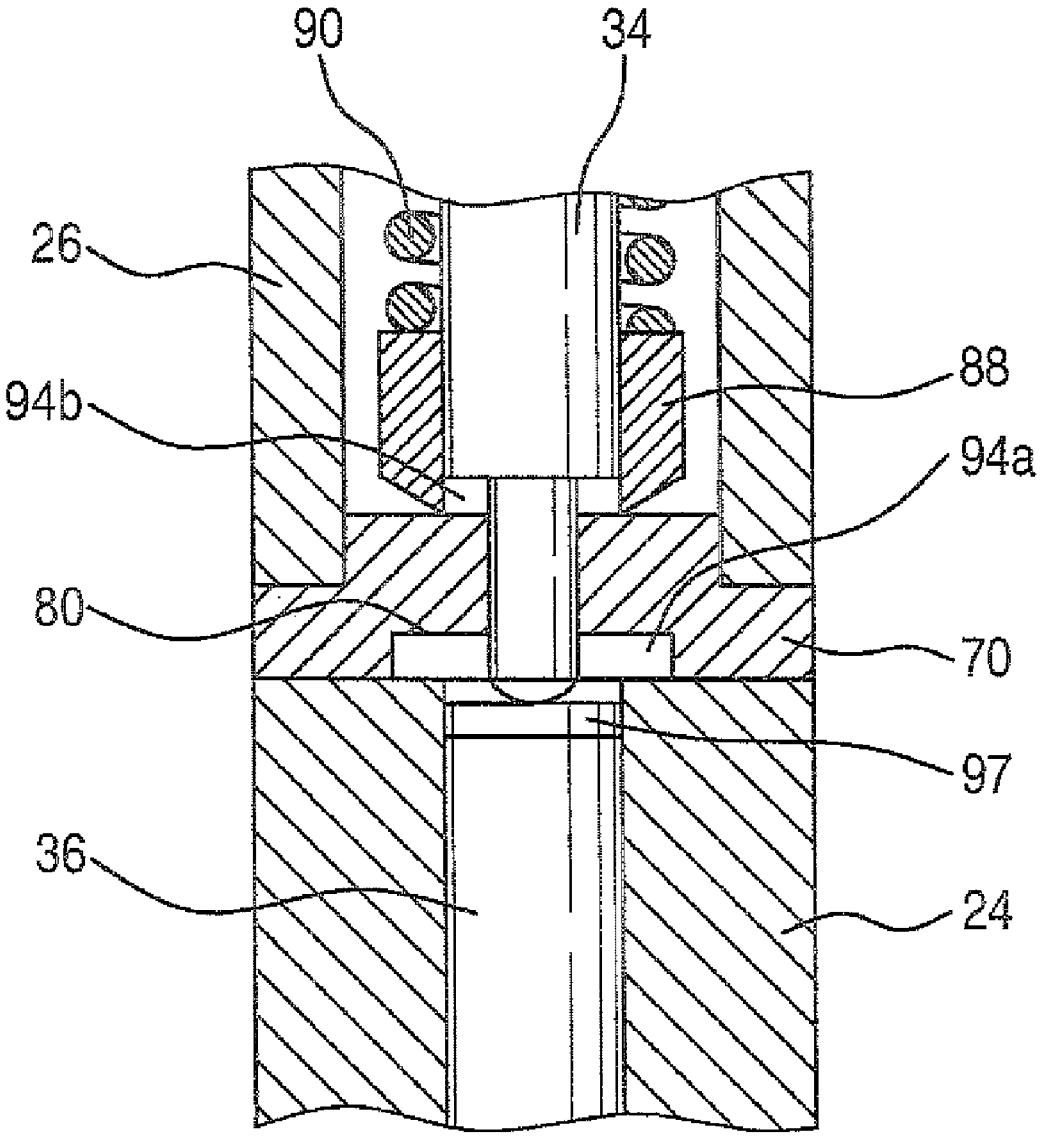
FIG. 7 is a depiction similar to FIG. 2 of a region of a third embodiment of a fuel injection device.

In an alternative exemplary embodiment shown in FIG. 7, a stroke adjusting element 97 is situated between the end surface 96 and the stroke stop 80 and also makes it possible to adjust a desired stroke of the nozzle needle 36.

In order to terminate an injection, the switching valve 66 is brought back into its closed position in which it shuts off the connection between the control chamber 56 and the low-pressure connection 21. Due to the presence of the inlet throttle 58, the pressure in the control chamber 56 continuously increases. As a result, the control piston 34 is moved in the closing direction again since the pressure in the coupling chamber 94*a*, 94*b* is initially less than the pressure in the control chamber 56. As a result, the pressure in the coupling chamber 94*a*, 94*b* increases again due to the decrease in volume, causing a closing motion of the nozzle needle 36.

Figure 8:
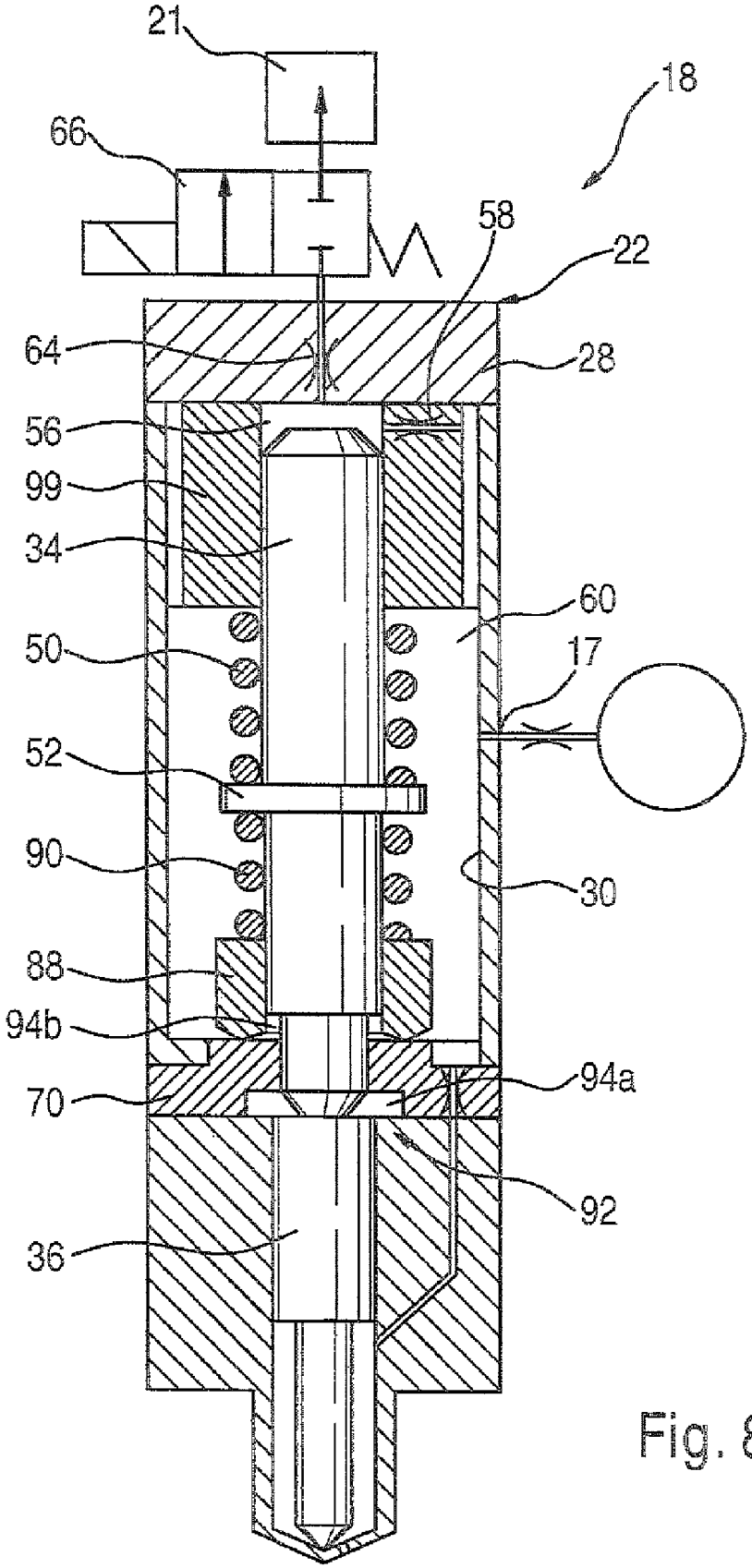
FIG. 8 is a depiction similar to FIG. 2 of a fourth embodiment.

FIG. 8 shows an alternative embodiment of a fuel injection device 18. Not only here, but essentially in all of the figures, those elements and regions that have functions equivalent to those of previously described elements and regions are provided with the same reference numerals and are not explained again in detail. For the sake of simplicity, the drawings essentially include only those reference numerals that are required for explanation of the differences in relation to a preceding exemplary embodiment.

By contrast with the exemplary embodiment shown in FIGS. 2 and 3, the spring 90, which pushes the sleeve 88 encompassing the coupling subchamber 94*b* against the guide element 70, does not rest against the main body 26, but rather against the annular collar 52 and the shoulder that the latter constitutes. The two springs 90 and 50 thus engage the same annular collar 52 of the control piston 34. The force component of the spring 90 acting in the opening direction must therefore be taken into account in the embodiment of the spring 50. A further difference in relation to the exemplary embodiment shown in FIGS. 2 and 3 lies in the two-part embodiment of the end body 28. This end body is split so that the outlet throttle 64 is situated in the remaining end body 28 and the inlet throttle 58 is situated in the sleeve 99, which is now a separate component. The spring 50 in this case pushes the sleeve 99 with its sealing surface or sealing edge (unnumbered) against the end body 28, thus producing a sufficient separation of the annular chamber 60 from the control chamber 56.

The advantage of the fuel injection device 18 shown in FIG. 8 over the one shown in FIGS. 2 and 3 lies in the fact that the control piston 34 can form a preassembled unit with the sleeve 99, the spring 50, the spring 90, and the sleeve 88 so that in the subsequent assembly of all the components of the fuel injection device 18, it is no longer necessary to separate the sleeves 99 and 88 from the control piston 34. In addition, the recess 30 in the main body 26 of the housing 22 can be embodied as a smooth through bore, which permits the establishment of a comparatively large annular chamber 60 and a comparatively large reservoir volume for the fuel.

Figure 9:
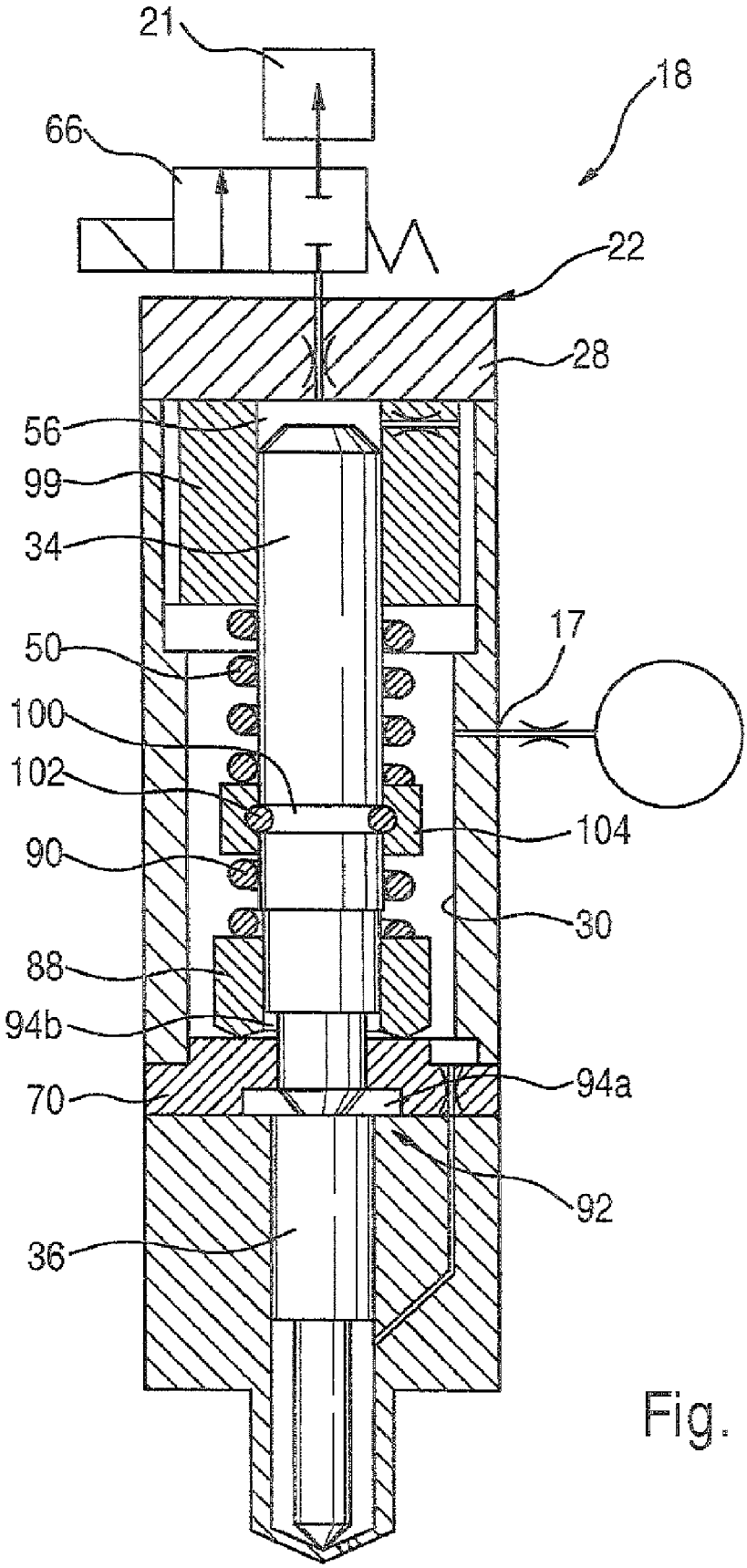
FIG. 9 is a depiction similar to FIG. 2 of a fifth embodiment.

FIG. 9 shows a similar variant: here, in lieu of an annular collar 52 in the control piston 34, a circumferential groove 100 is provided, into which an annular coupling element 102 is inserted against which in turn an annular element 104 rests, but only in the closing direction of the valve element 32. This annular element 104 is engaged by the spring 90 on the one side and by the spring 50 on the other. Here, too, the control piston 34, the sleeve 99, the spring 50, the sleeve 88, the spring 90, the coupling element 102, and the annular element 104 can form a preassembled unit that can be stored as such and in the final assembly, can be inserted into the recess 30 in the main body 26 of the housing 22.

The foregoing relates to the preferred exemplary embodiment of the invention, it being understood that other variants and embodiments thereof are possible within the spirit and scope of the invention, the latter being defined by the appended claims.

The invention claimed is:

1. A fuel injection device for an internal combustion engine, comprising:

a housing;

a fuel outlet opening disposed in the housing;

a valve seat embodied by the housing in the vicinity of the fuel outlet opening;

a valve element disposed in the housing and cooperating with the valve seat, the valve element having at least one first part and at least one second part;

a hydraulic coupler coupling together the at least one first part and at least one second part of the valve element, the hydraulic coupler having a coupling chamber;

a sleeve guided on the first part of the valve element, the sleeve at least partially delimiting the coupling chamber and being separate from the housing; and a guide element guiding an end region of the first part of the valve element oriented toward the second part of the valve element, the guide element being separate from the second part of the valve element, wherein the guide element has a fluid conduit with a through opening that connects a pressure chamber in the region of the valve seat at least indirectly to a high-pressure connection, and wherein the sleeve is acted on by a first spring that rests against a shoulder embodied on one side of an annular element, another side of the annular element is acted on by a second spring which rests at least indirectly against the housing, the annular element being coupled to the valve element in its closing direction by means of a coupling element.

2. The fuel injection device according to claim 1, wherein the sleeve rests against the guide element.

3. The fuel injection device according to claim 2, wherein at least one part of a guide region of the guide element or a complementary region of the first part of the valve element, a fluid passage is provided, which leads from one side of the guide element to the other.

4. The fuel injection device according to claim 1, wherein the guide element includes a stroke stop for the second part of the valve element.

5. The fuel injection device according to claim 2, wherein the guide element includes a stroke stop for the second part of the valve element.

6. The fuel injection device according to claim 3, wherein the guide element includes a stroke stop for the second part of the valve element.

7. The fuel injection device according to claim 4 wherein a stroke adjusting element is disposed between the stroke stop and the second part of the valve element.

8. The fuel injection device according to claim 5, wherein a stroke adjusting element is disposed between the stroke stop and the second part of the valve element.

9. The fuel injection device according to claim 6, wherein a stroke adjusting element is disposed between the stroke stop and the second part of the valve element.

10. The fuel injection device according to claim 1, wherein the through opening includes a flow throttle.

11. The fuel injection device according to claim 1, wherein the guide element is clamped between two housing bodies, the guide element having contact surfaces in contact with the housing bodies embodied so that center points of a surface area of the contact surfaces are aligned at least approximately on a center axis of a guide region of the guide element.

12. The fuel injection device according to claim 3, wherein the guide element is clamped between two housing bodies, the guide element having contact surfaces in contact with the housing bodies embodied so that center points of a surface area of the contact surfaces are aligned at least approximately on a center axis of the guide region of the guide element.

13. The fuel injection device according to claim 1, wherein the sleeve is acted on by a spring that rests against a shoulder embodied on the first part of the valve element.

14. The fuel injection device according to claim 1, wherein the guide element has a centering section, preferably a centering collar, which centers the guide element in relation to a housing body.

* * * * *